US008183989B2

(12) United States Patent
Tsai

(10) Patent No.: US 8,183,989 B2
(45) Date of Patent: May 22, 2012

(54) EMERGENCY EXIT INDICATOR AND EMERGENCY EXIT INDICATING SYSTEM

(75) Inventor: Wen-Kuei Tsai, Taipei County (TW)

(73) Assignee: GE Investment Co., Ltd., Taipei (TW)

( * ) Notice: Subject to any disclaimer, the term of this patent is extended or adjusted under 35 U.S.C. 154(b) by 372 days.

(21) Appl. No.: 12/507,052

(22) Filed: Jul. 21, 2009

(65) Prior Publication Data

US 2010/0019901 A1 Jan. 28, 2010

(30) Foreign Application Priority Data

Jul. 22, 2008 (TW) ..... 97127862 A

(51) Int. Cl.
*G08B 3/00* (2006.01)

(52) U.S. Cl. ..... 340/330; 340/628; 340/326; 340/332; 340/815.69; 340/506; 40/570; 40/488; 40/491

(58) Field of Classification Search ..... 340/628, 340/326, 332, 815.69, 691.8, 506; 40/570, 40/488, 491

See application file for complete search history.

(56) References Cited

U.S. PATENT DOCUMENTS 5,905,442 A * 5/1999 Mosebrook et al. ..... 340/3.7
6,441,723 B1 * 8/2002 Mansfield et al. ..... 340/538.11
6,848,798 B1 * 2/2005 Logan et al. ..... 362/20
2002/0007304 A1 * 1/2002 Kasajima et al. ..... 705/10
2004/0064991 A1 * 4/2004 Gow ..... 40/570
2007/0069882 A1 * 3/2007 Mahajan ..... 340/500
2007/0096663 A1 * 5/2007 Wong et al. ..... 315/312

FOREIGN PATENT DOCUMENTS

CN 101119771 2/2008
CN 201048022 4/2008
DE 10331385 A1 1/2005
EP 1865484 12/2007
EP 1865484 A1 12/2007

OTHER PUBLICATIONS

"Search Report of European Counterpart Application", issued on Jan. 8, 2010, p. 1-7.

* cited by examiner

*Primary Examiner* — Daryl Pope
(74) *Attorney, Agent, or Firm* — Muncy, Geissler, Olds & Lowe, PLLC

(57) ABSTRACT

An emergency exit indicator includes a light source, a visual indicator and a power line communication unit, wherein the visual indicator is disposed within the illumination scope of the light source, and the power line communication unit is electrically connected to the light source. The emergency exit indicator is capable of altering the displayed escape information. The present invention further provides an emergency exit indicating system using the above-mentioned emergency exit indicator and can more precisely display the escape information.

19 Claims, 10 Drawing Sheets

EMERGENCY EXIT INDICATOR AND EMERGENCY EXIT INDICATING SYSTEM

CROSS-REFERENCE TO RELATED APPLICATION

This application claims the priority benefit of Taiwan application serial no. 97127862, filed on Jul. 22, 2008. The entirety of the above-mentioned patent application is hereby incorporated by reference herein and made a part of this specification.

BACKGROUND OF THE INVENTION

1. Field of the Invention

The present invention generally relates to a lighting apparatus, and more particularly, to an emergency exit indicator and an emergency exit indicating system using the same.

2. Description of Related Art

An emergency exit indicator is counted as a standard equipments for public facilities, such as big building, airplane or ship. When a disaster occurs, the emergency exit indicator is able to indicate the location of an emergency escape exit for people so as to assist people evacuation. A conventional emergency exit indicator usually is disposed near an emergency exit and shows a fixed direction. However, when a disaster occurs, the hallway or the emergency exit may be closed due to some reasons. Therefore, the emergency exit indicator showing a fixed direction is unable point out an effective evacuation direction. For example, when a fire occurs, a hallway may not be suitable for people to pass due to fierce burning fire. In such a circumstance, if an emergency exit indicator fails to indicate a correct evacuation direction, people may lose time due to seeking by one's self escape passage direction, and may get perished due to a wrong escape direction given by the emergency exit indicator.

SUMMARY OF THE INVENTION

Accordingly, the present invention is directed to an emergency exit indicator capable of dynamically altering indications of escape direction.

The present invention is also directed to an emergency exit indicating system capable of altering indications of escape direction.

To solve the above-mentioned problems, the present invention provides an emergency exit indicator, which includes a light source, a visual indicator and a power line communication unit. The visual indicator herein is disposed within the illumination scope of the light source and the power line communication unit is electrically connected to the light source.

In an embodiment of the present invention, the above-mentioned visual indicator includes a direction-indicating sign.

In an embodiment of the present invention, the above-mentioned emergency exit indicator further includes a speaker electrically connected to the power line communication unit.

In an embodiment of the present invention, the above-mentioned emergency exit indicator further includes a sensor electrically connected to the power line communication unit.

In an embodiment of the present invention, the above-mentioned emergency exit indicator further includes a video camera electrically connected to the power line communication unit.

In an embodiment of the present invention, the above-mentioned emergency exit indicator further includes an independent power supply electrically connected to the light source, the power line communication unit and the visual indicator.

The present invention also provides an emergency exit indicating system, which includes a sub-system of power supply, a monitoring center and a plurality of emergency exit indicators. The sub-system of power supply herein includes a first power, a second power, a switch board, a relay device and a control device. The switch board is electrically connected to the first power, and the relay device is electrically connected to the first power, the second power and the switch board. The control device includes a control unit, a first power line communication unit and a second power line communication unit, wherein the control unit is electrically connected to the second power, the first power line communication unit is electrically connected between the relay device and the second power line communication unit, the first power line communication unit is electrically connected to the control unit, and the second power line communication unit is electrically connected to the control unit. The monitoring center is electrically connected to the control unit. The emergency exit indicators are electrically connected to the switch board, and each of the emergency exit indicators includes a light source, a visual indicator and a third power line communication unit. The visual indicator herein is disposed within the illumination scope of the light source, and the third power line communication unit is electrically connected to the light source and the second power line communication unit.

In an embodiment of the present invention, the above-mentioned second power includes a solar panel and a rectifier, wherein the rectifier is electrically connected to the solar panel, a second solid relay and the first power line communication unit.

In an embodiment of the present invention, the above-mentioned second power further includes a storage battery and is electrically connected to the solar panel and the rectifier.

In an embodiment of the present invention, the above-mentioned relay device includes a fourth power line communication unit, a first solid relay, a second solid relay and a switching unit. The fourth power line communication unit is electrically connected to the first power line communication unit. The first solid relay is electrically connected to the first power and the switch board. The second solid relay is electrically connected to the second power and the switch board. The switching unit is electrically connected to the fourth power line communication unit, the first solid relay and the second solid relay.

In an embodiment of the present invention, the above-mentioned relay device includes a fourth power line communication unit and a programmable logic controller unit (PLC unit). The fourth power line communication unit is electrically connected to the first power line communication unit, and the PLC unit is electrically connected to the fourth power line communication unit, the first power, the second power and the switch board.

In an embodiment of the present invention, the above-mentioned switch board includes a plurality of first control switches and a plurality of second control switches. The first control switches are electrically connected to the first power and the second control switches are electrically connected to the relay device and the emergency exit indicators.

In an embodiment of the present invention, the above-mentioned emergency exit indicating system further includes a sub-system of wireless communication network, and the sub-system of wireless communication network includes a host electrically connected to the control unit and a plurality of nodes connected to the host.

In an embodiment of the present invention, the above-mentioned sub-system of wireless communication network is a mesh network.

In an embodiment of the present invention, the above-mentioned sub-system of wireless communication network is an IEEE 802.15.4 ZigBee wireless communication system, a ZigBee-Pro wireless communication system or a Z-Wave wireless communication system.

In an embodiment of the present invention, the above-mentioned nodes are disposed within the emergency exit indicators.

In an embodiment of the present invention, the above-mentioned host has an independent power supply.

In an embodiment of the present invention, each of the above-mentioned nodes has an independent power supply.

In an embodiment of the present invention, the above-mentioned further includes a plurality of illumination devices electrically connected to the switch board.

In an embodiment of the present invention, the above-mentioned illumination device is an emergency illumination device.

In an embodiment of the present invention, the above-mentioned visual indicator includes a direction-indicating sign.

In an embodiment of the present invention, the above-mentioned emergency exit indicator further includes a speaker electrically connected to the power line communication unit.

In an embodiment of the present invention, the above-mentioned emergency exit indicator further includes a sensor electrically connected to the power line communication unit.

In an embodiment of the present invention, the above-mentioned emergency exit indicator further includes a video camera electrically connected to the power line communication unit.

In an embodiment of the present invention, the above-mentioned emergency exit indicator further includes an independent power supply electrically connected to the light source, the power line communication unit and the visual indicator.

As discussed above, since the emergency exit indicator of the present invention has a power line communication unit and is electrically connected to the light source and the visual indicator; therefore, the light source and the visual indicator are able to alter the escape direction indication shown by the emergency exit indicator according to the signal of the power line communication unit. In this way, the escape direction indication shown by the emergency exit indicator can be dynamically altered, which enables the emergency exit indicator to more precisely indicate and furthermore reduces casualty due to a wrong indication during a disaster.

BRIEF DESCRIPTION OF THE DRAWINGS

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE EMBODIMENTS

Figure 1:
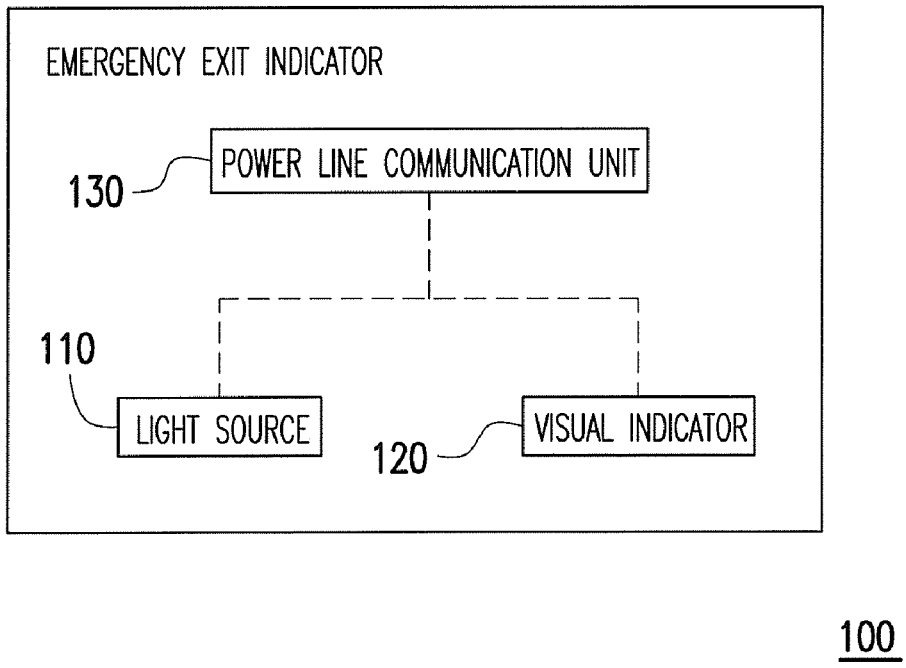
FIG. 1 is a block diagram showing the architecture of an emergency exit indicator according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a block diagram showing the architecture of an emergency exit indicator according to an embodiment of the present invention. Referring to FIG. 1, an emergency exit indicator 100 includes a light source 110, a visual indicator 120 and a power line communication unit 130. The light source 110 can be a light-emitting diode light source (LED light source) or a fluorescent light source. The visual indicator 120 is disposed within the illumination scope of the light source 110 for displaying the escape direction information. The power line communication unit 130 is electrically connected to the light source 110.

Figure 2A:
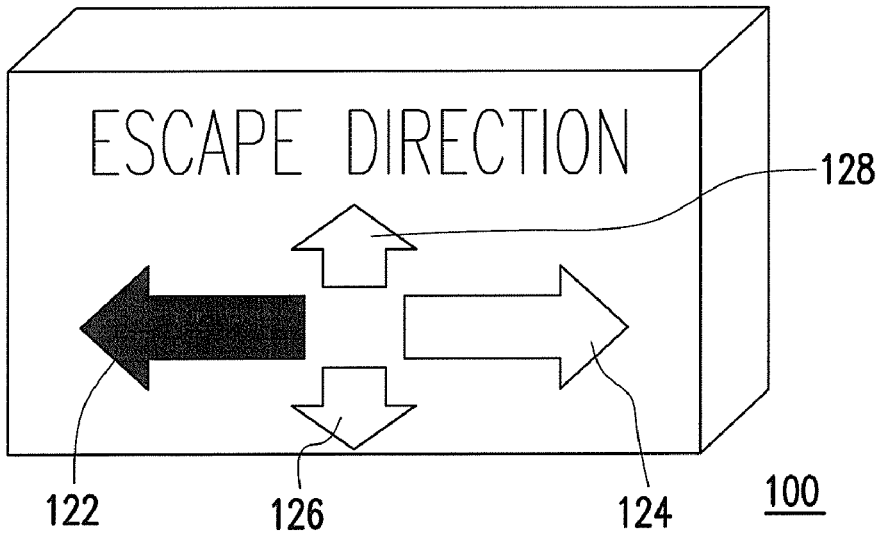
FIGS. 2A and 2B are outlook diagrams of the emergency exit indicator of FIG. 1.
Figure 2B:
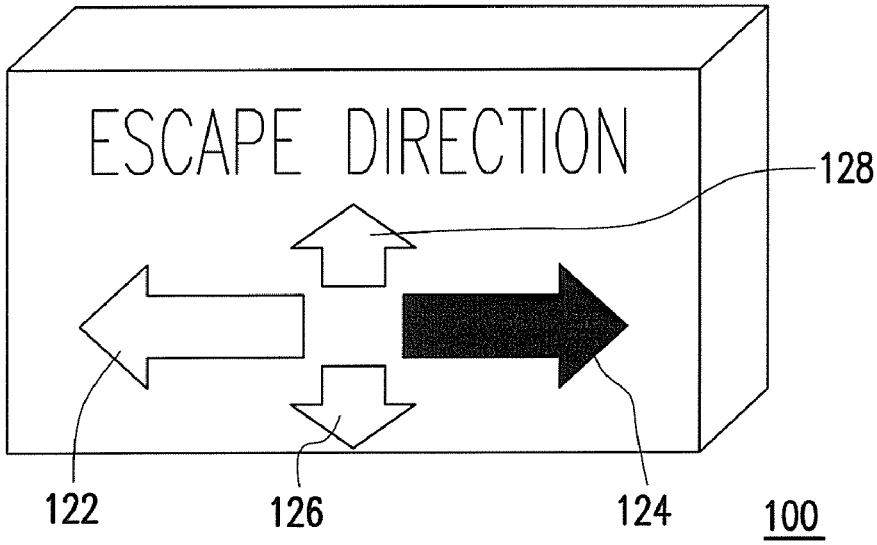
Figure 3A:
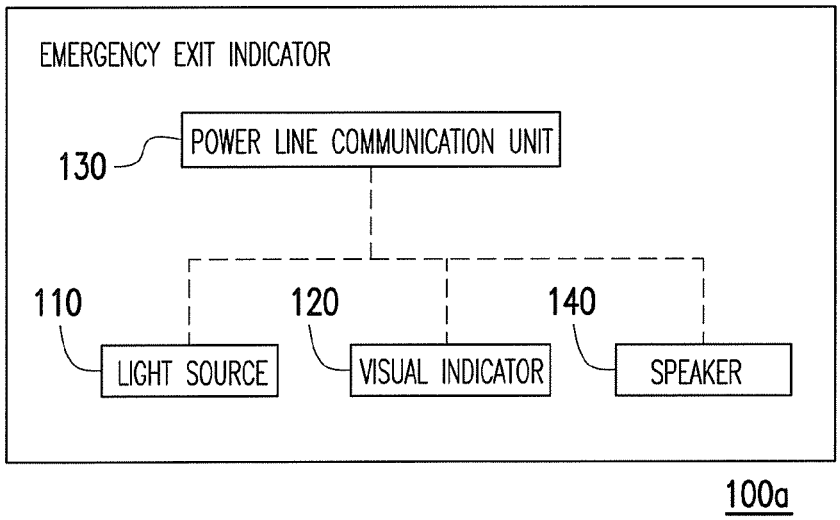
FIGS. 3A and 3B are block diagrams showing other implemented architectures of the emergency exit indicator of FIG. 1.

FIGS. 2A and 2B are outlook diagrams of the emergency exit indicator of FIG. 1. Referring to FIGS. 2A and 2B, in more detail, the visual indicator 120 can include a first arrow sign 122 and a second arrow sign 124 both for indicating directions. There is a controller (not shown) embedded in the light source 110 and the visual indicator 120, wherein the controller receives instructions from the power line communication unit 130 and controls the light source 110 to illuminate the first arrow sign 122 (as shown by FIG. 2A) and a second arrow sign 124 (as shown by FIG. 2B). Additionally, the emergency exit indicator 100 can have other devices for indicating directions. FIG. 3A is a block diagram showing another implemented architecture of the emergency exit indicator of FIG. 1. Referring to FIG. 3A, an emergency exit indicator 100*a* can further have a speaker 140 electrically connected to the power line communication unit 130, wherein the speaker 140 receives instructions from the power line communication unit 130 so as to deliver an audio escape information. Besides, the emergency exit indicator can be implemented in other ways. In an embodiment of the present invention, the light source can be a backlight module and the visual indicator can be a liquid crystal display panel or an OLED (organic light-emitting diode) display panel so as to provide escape information in more detail.

Figure 3B:
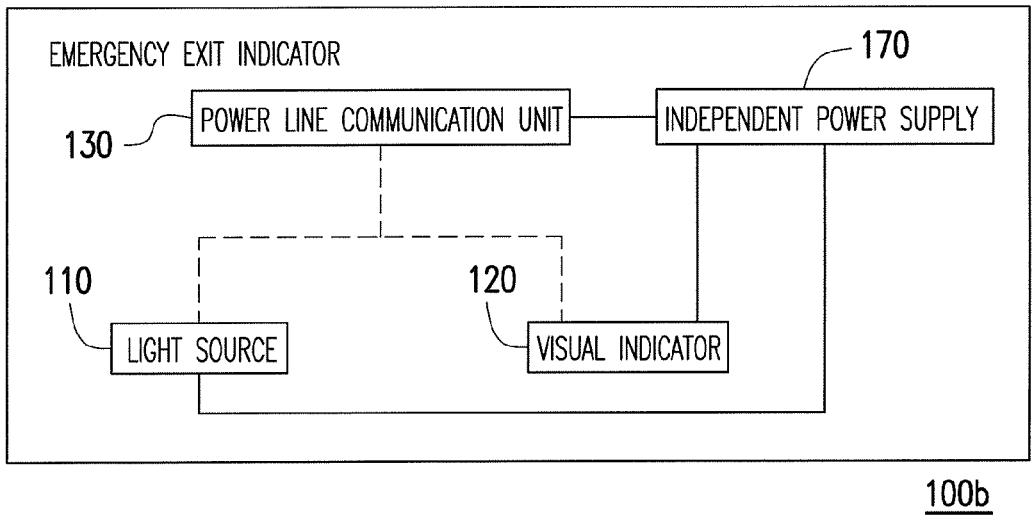

The emergency exit indicator 100 can further have an independent power supply. FIG. 3B is a block diagram showing yet another implemented architecture of the emergency exit indicator of FIG. 1. Referring to FIG. 3B, an emergency exit indicator 100*b* has an independent power supply 170, which is, for example, a battery or a super-capacitor and electrically connected to each of the devices the emergency exit indicator 100*b* includes (the light source 110, the visual indicator 120 and the power line communication unit 130) to ensure the emergency exit indicator 100*b* can normally run without an external power. For example, when the wired power of the emergency exit indicator 100*b* is disabled during a disaster (for example, a fire burns off the wire connected to the power), the emergency exit indicator 100*b* still keeps normally running by means of the independent power supply 170 and correct escape information still can be provided to the people in the disaster site.

Since the emergency exit indicator 100 of the above-mentioned embodiment can alter the displayed information of the visual indicator 120, that is, the information provided by the visual indicator 120 can be dynamically altered; thus, the emergency exit indicator 100 can more correctly display escape information and further reduce casualty in a disaster.

The emergency exit indicator 100 has a controller 140, which enables the emergency exit indicator 100 to flexibly adjust the luminance thereof. For example, the daily output of the light source 110 is a half of the maximal power thereof only for saving electricity; but when a disaster occurs, the light source 110 would output the maximal power.

The above-mentioned emergency exit indicator 100 can in association with a power supply system of a public facility establishes an emergency exit indicating system. In following, the emergency exit indicator 100 in association with, for example, the power supply system of a big building establishes an emergency exit indicating system 600 to exemplarily describe the application of the emergency exit indicator 100.

Figure 4:
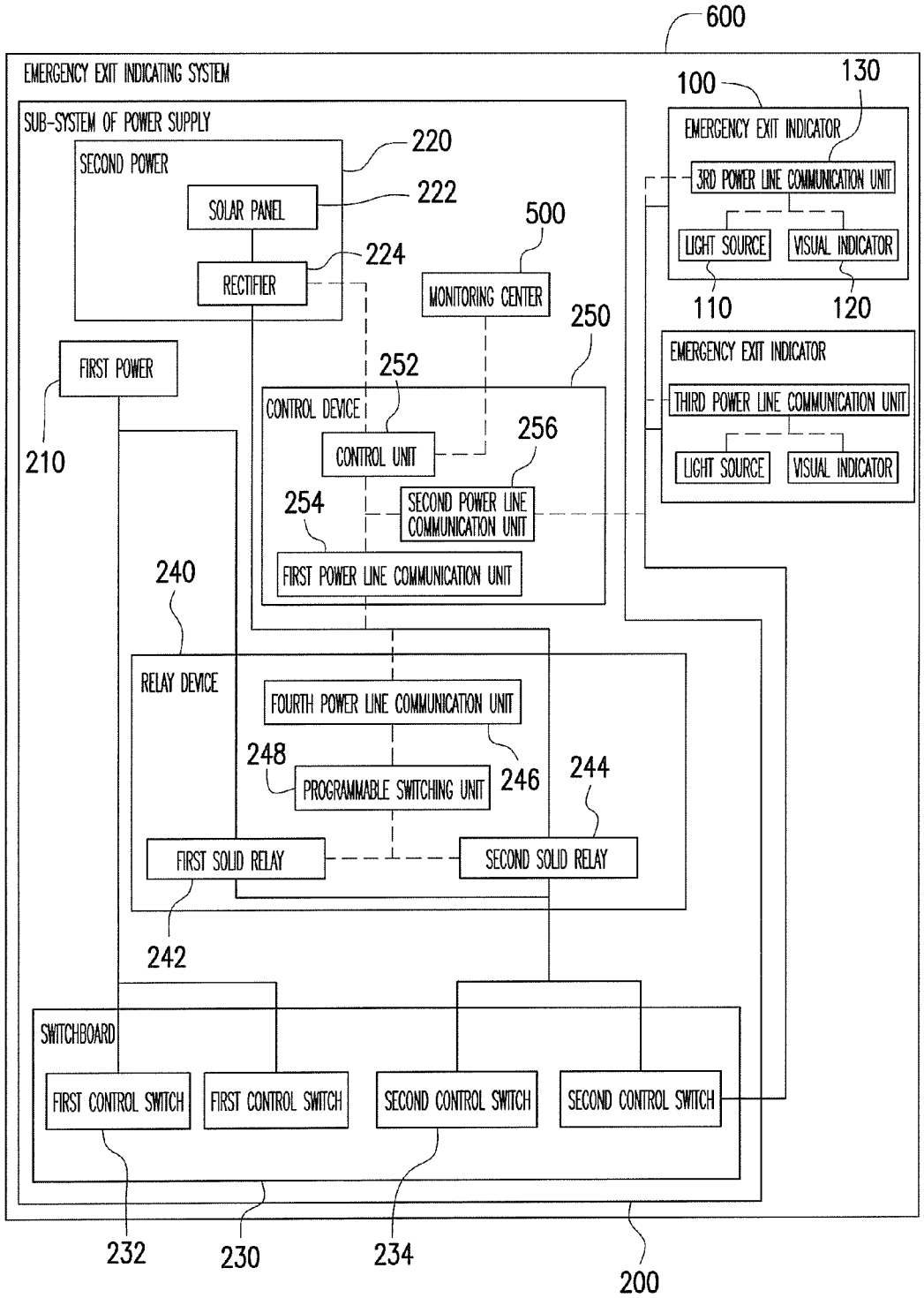
FIG. 4 is a block diagram of an emergency exit indicating system according to an embodiment of the present invention.

FIG. 4 is a block diagram of an emergency exit indicating system according to an embodiment of the present invention. Referring to FIG. 4, an emergency exit indicating system 600 includes a plurality of emergency exit indicators 100, a sub-system of power supply 200 and a monitoring center 500. The sub-system of power supply 200 includes a first power 210, a second power 220, a switch board 230, a relay device 240 and a control device 250. The switch board 230 is, for example, responsible for distributing the power for a building, and distributing the electric power provided by the residential power supply.

The control device 250 includes a control unit 252, a first power line communication unit 254 and a second power line communication unit 256, wherein the control unit 252 is electrically connected to the monitoring center 500, the second power 220, the first power line communication unit 254 and the second power line communication unit 256. The first power line communication unit 254 is electrically connected between the relay device 240 and the second power 220, and the second power line communication unit 256 is electrically connected to the third power line communication unit 130 of the emergency exit indicator 100 (i.e., the power line communication unit mentioned hereinbefore). The second power line communication unit 256 can communicate with the third power line communication unit 130, so that the control unit 252 controls the emergency exit indicator 100 through the second power line communication unit 256 and the third power line communication unit 130. Note that the control device 250 can have an independent power supply (not shown) and is electrically connected to the control unit 252, the first power line communication unit 254 and the second power line communication unit 256.

In more detail, the monitoring center 500 can be a monitoring center of a big building and electrically connected to a smog detector, a fire alarm, a building access control system and a communication system for monitoring. In this way, the monitoring center 500 is able to inform the control unit 252 for reacting to an accident according to the detected situation. The control unit 252 is also able to judge and decide a preferred escape path according to the information delivered by the monitoring center 500, so as to control the emergency exit indicator 100 for guiding the people evacuated.

Figure 5:
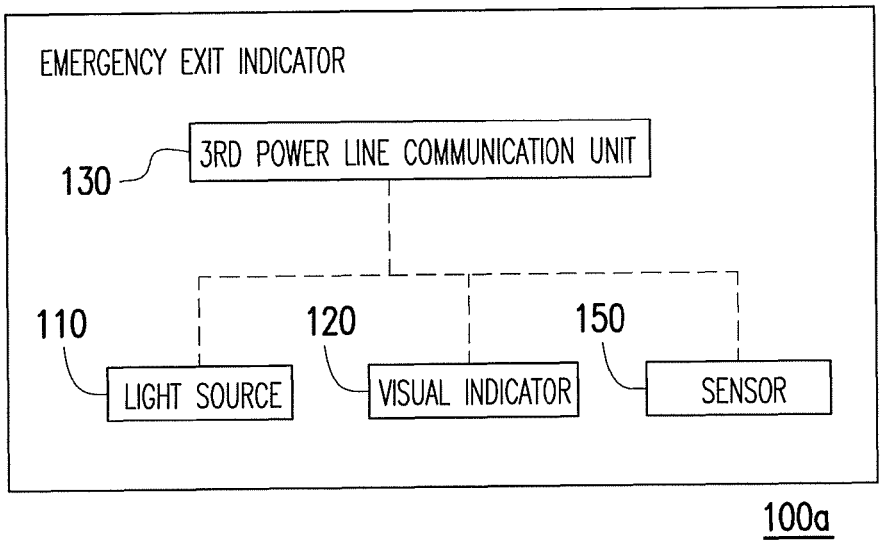
FIGS. 5 and 6 are block diagrams showing other implemented architectures of the emergency exit indicator of FIG. 4.
Figure 6:
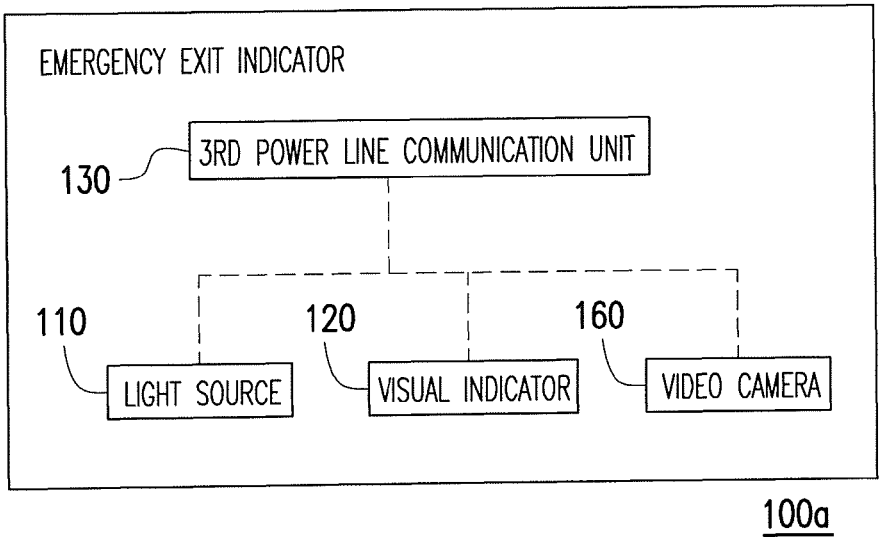

FIGS. 5 and 6 are block diagrams showing other implemented architectures of the emergency exit indicator of FIG. 4. Referring to FIGS. 5 and 6, the emergency exit indicator 100 can further employ a sensor 150 (as shown in FIG. 5) electrically connected to the third power line communication unit 130, wherein the sensor 150 is, for example, a temperature sensor for assisting the control unit 252 to judge a correct escape path. The emergency exit indicator 100 can further employ a video camera 160 (as shown in FIG. 6) electrically connected to the third power line communication unit 130, wherein the video camera 160 is in charge of providing the control unit more detail information regarding the site circumstance for further assisting the control unit 252 to plan an escape path. In addition to the above-mentioned sensor and video camera, the emergency exit indicator can further include other auxiliary devices for indicating emergency exit, for example, an emergency button, an output-controlling terminal, a broadcaster, a microphone etc. so as to provide the escape people with more detail escape information and make the control unit better command the site circumstance. For example, the output-controlling terminal can be used to control the door switch and close the door leading to a danger site (for example, a location with fierce blaze) to prevent the escape people from jeopardy.

Continuing to FIG. 4, the above-mentioned switch board 230 is electrically connected to the first power 210, and the relay device 240 is electrically connected to the switch board 230, wherein the relay device 240 includes a first solid relay 242, a second solid relay 244, a fourth power line communication unit 246 and a switching unit 248. The first solid relay 242 and the second solid relay 244 are respectively electrically connected to the first power 210 and the second power 220. The fourth power line communication unit 246 is electrically connected to the second power 220 the switching unit 248. The first power line communication unit 254 and the fourth power line communication unit 246 can be communicated with each other so as to control the switching unit 248 for switching the power supply for the first solid relay 242 and the second solid relay 244.

In more detail, in the embodiment, the sub-system of power supply 200 can be a power supply system of a big building. The first power 210 herein can be a domestic power supply, for example, a power supply provided by a power generator or from a power station, and the second power 220 can be an auxiliary power, for example, a solar electric power. For example, the second power 220 can include a solar panel 222 and a rectifier 224, wherein the rectifier 224 is electrically connected to the solar panel 222, the second solid relay 244 and the first power line communication unit 254. In the present embodiment, the rectifier 224 may be an inverter for rectifying DC power to AC power or a rectifying unit for rectifying DC power to another DC power if required.

The switch board 230 can include a plurality of first control switches 232 and a plurality of second control switches 234. The first control switches 232 are electrically connected to the first power 210, and the second control switches 234 are electrically connected to the relay device 240. More particularly, the first control switches 232 are used, for example, to control an electronic device requiring a larger power, for example, an air-conditioning system or an elevator; the second control switches 234 are used to control a device requiring a less power, for example, the above-mentioned emergency exit indicator 100. When a disaster occurs in a building, the control unit 252 controls the relay device 240 to turn off the first power 210 for safety. Meanwhile, the control unit 252 would make the second power 220 provide the emergency exit indicator 100 with required power to assist people for escaping.

Figure 7A:
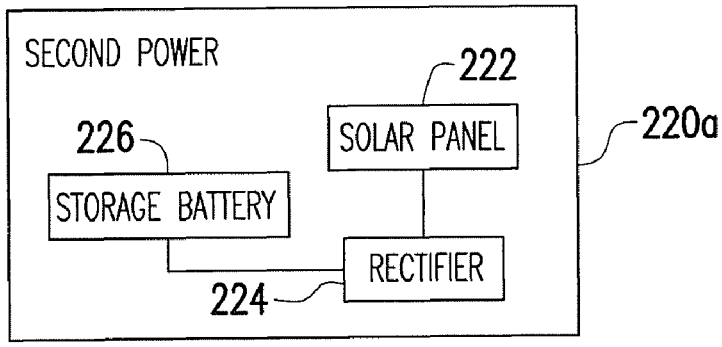
FIGS. 7A and 7B are block diagrams showing other implemented architectures of the second power of FIG. 4
Figure 7B:
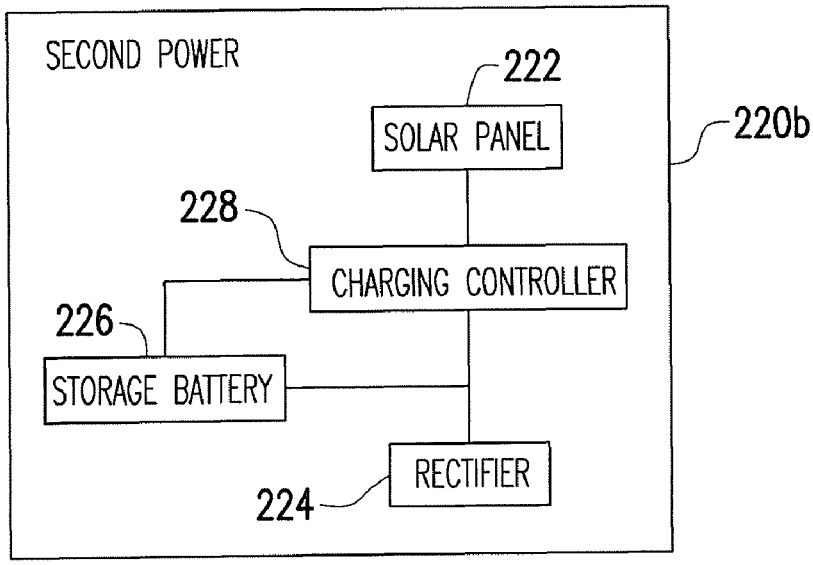

Note that, in addition to the above-mentioned implements, the second power can be implemented in other ways. FIGS. 7A and 7B are block diagrams showing other implemented architectures of the second power of FIG. 4. Referring to FIGS. 4, 7A and 7B, the second power 220*a* in FIG. 7A can be a storage battery 226 electrically connected to the solar panel 222 and the rectifier 224, so that the storage battery 226 is able to store the current produced by the solar panel 222 for emergency use. In addition, the second power 220*b* in FIG. 7B further has a charging controller 228 electrically connected between the solar panel 222 and the storage battery 226 and the rectifier 224 for controlling the power-feeding proportion of the solar panel 222 between the storage battery 226 and the rectifier 224.

Figure 8:
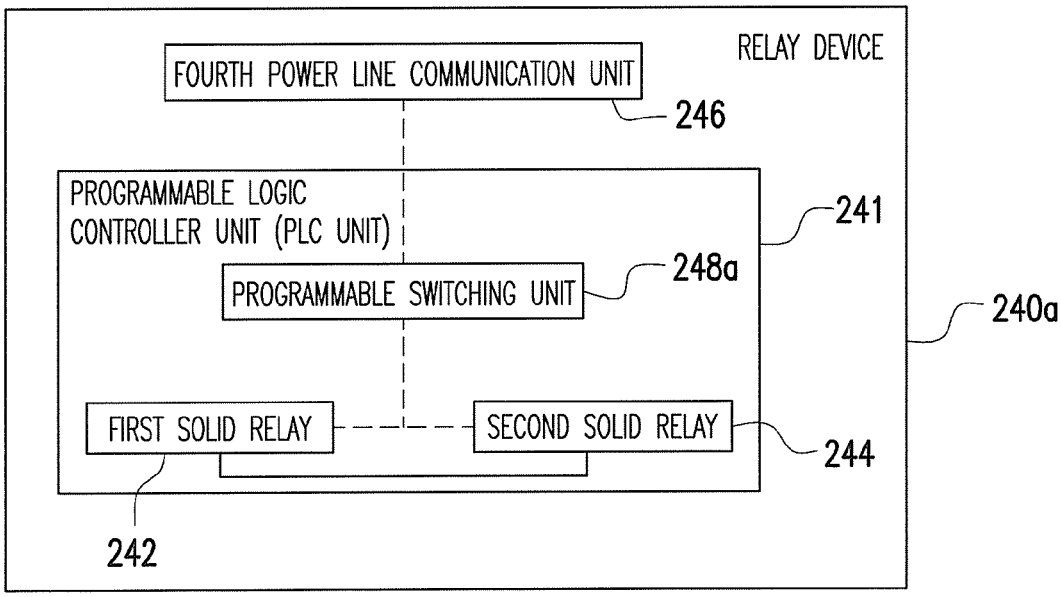
FIG. 8 is a block diagram showing another implemented architecture of the relay device of FIG. 4.

The relay device can be implemented in other ways. FIG. 8 is a block diagram showing another implemented architecture of the relay device of FIG. 4. Referring to FIGS. 4 and 8, the relay device 240*a* includes, for example, a programmable logic controller unit (PLC unit) 241 electrically connected to the fourth power line communication unit 246. The PLC unit 241 can be vendible PLC unit and have, for example, a programmable switching unit 248*a*, a first solid relay 242 and a second solid relay 244, wherein the programmable switching unit 248*a* receives the instructions from the fourth power line communication unit 246 for switching the power supply for the first solid relay 242 and the second solid relay 244.

The above-mentioned emergency exit indicating system 600 can be used in association with other systems, for example, a wireless communication network system, an illumination device and the like. More embodiments are explained in the following to depict other applications of the emergency exit indicating system.

Figure 9:
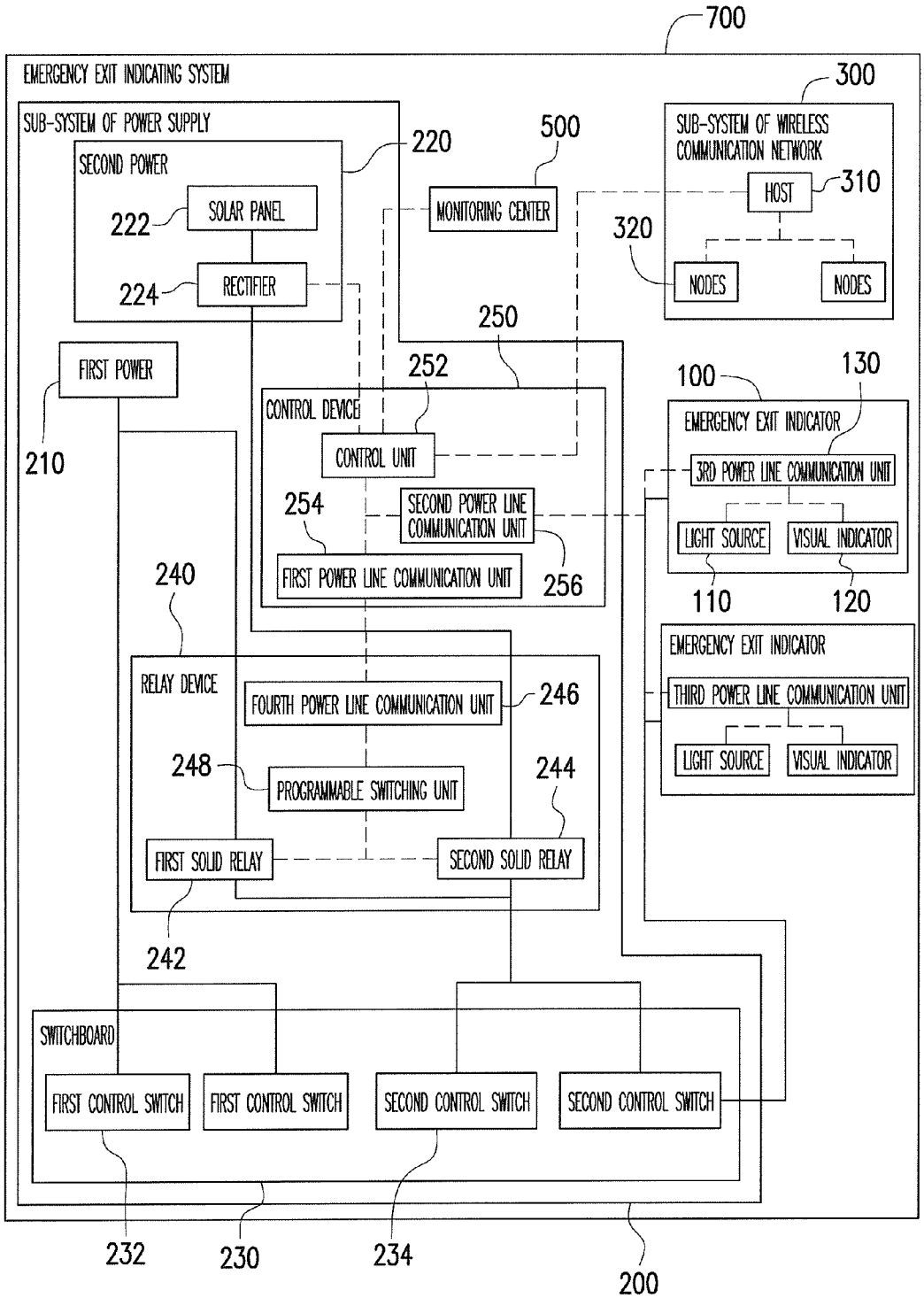
FIG. 9 is a block diagram of an emergency exit indicating system according to another embodiment of the present invention.

FIG. 9 is a block diagram of an emergency exit indicating system according to another embodiment of the present invention. Note that the present embodiment is partially similar to that of FIG. 4; therefore, the same parts or the similar parts as or to that of the embodiment of FIG. 4 are marked by the same or similar notations, and the same portions are omitted to describe for simplicity.

Referring to FIG. 9, an emergency exit indicating system 700 further includes a sub-system of wireless communication network 300, which includes a host 310 and a plurality of nodes 320. The host 310 herein is electrically connected to the control unit 252 and the nodes 320 are linked with the host 310. The sub-system of wireless communication network 300 is, for example, a mesh network system, and for example, an IEEE 802.15.4 ZigBee wireless communication system, a ZigBee-Pro wireless communication system or a Z-Wave wireless communication system. The nodes 320 are disposed within the emergency exit indicators 100. In this way, the control unit 252 can obtain the information regarding the personal distribution inside the building through the host 310 and accordingly plan a better escape path. Note that the host 310 and each of the nodes 320 can have an independent power supply (not shown), so that when the first power 210 and the second power 220 are off the host 310 and the nodes 320 can keep normal operations.

Figure 10:
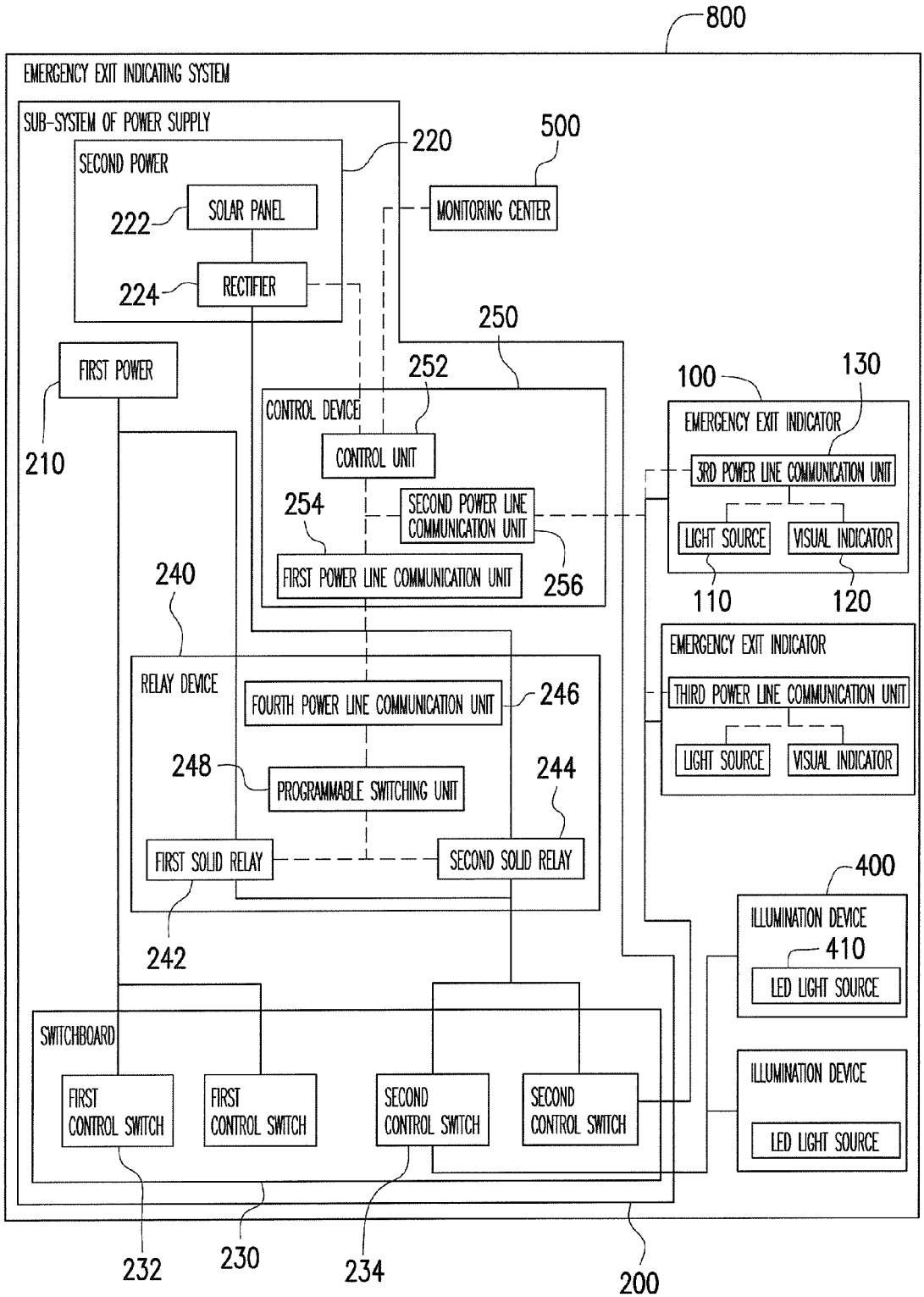
FIG. 10 is a block diagram of an emergency exit indicating system according to yet another embodiment of the present invention.

FIG. 10 is a block diagram of an emergency exit indicating system according to yet another embodiment of the present invention. Note that the present embodiment is partially similar to that of FIG. 4; therefore, the same parts or the similar parts as or to that of the embodiment of FIG. 4 are marked by the same or similar notations, and the same portions are omitted to describe for simplicity.

Referring to FIG. 10, an emergency exit indicating system 800 further includes a plurality of illumination devices 400, wherein each of the illumination devices 400 includes an LED light source 410. The illumination devices 400 are electrically connected to the second control switches 234, and the relay device 240 and the switch board 230 are in charge of assigning the powers of the first power 210 and the second power 220 to the illumination devices 400 for illumination. The illumination devices 400 can be, for example, an emergency illumination device. When the first power 210 does not supply power, the control device 250 controls the relay device 240 to make the second power 220 continue supplying emergency power to the illumination devices 400 to ensure the escaped people having enough illumination. The illumination device 400 can have an independent power and the implement thereof can refer the emergency exit indicator 100*b* in FIG. 3B and is omitted herein for simplicity.

Figure 11:
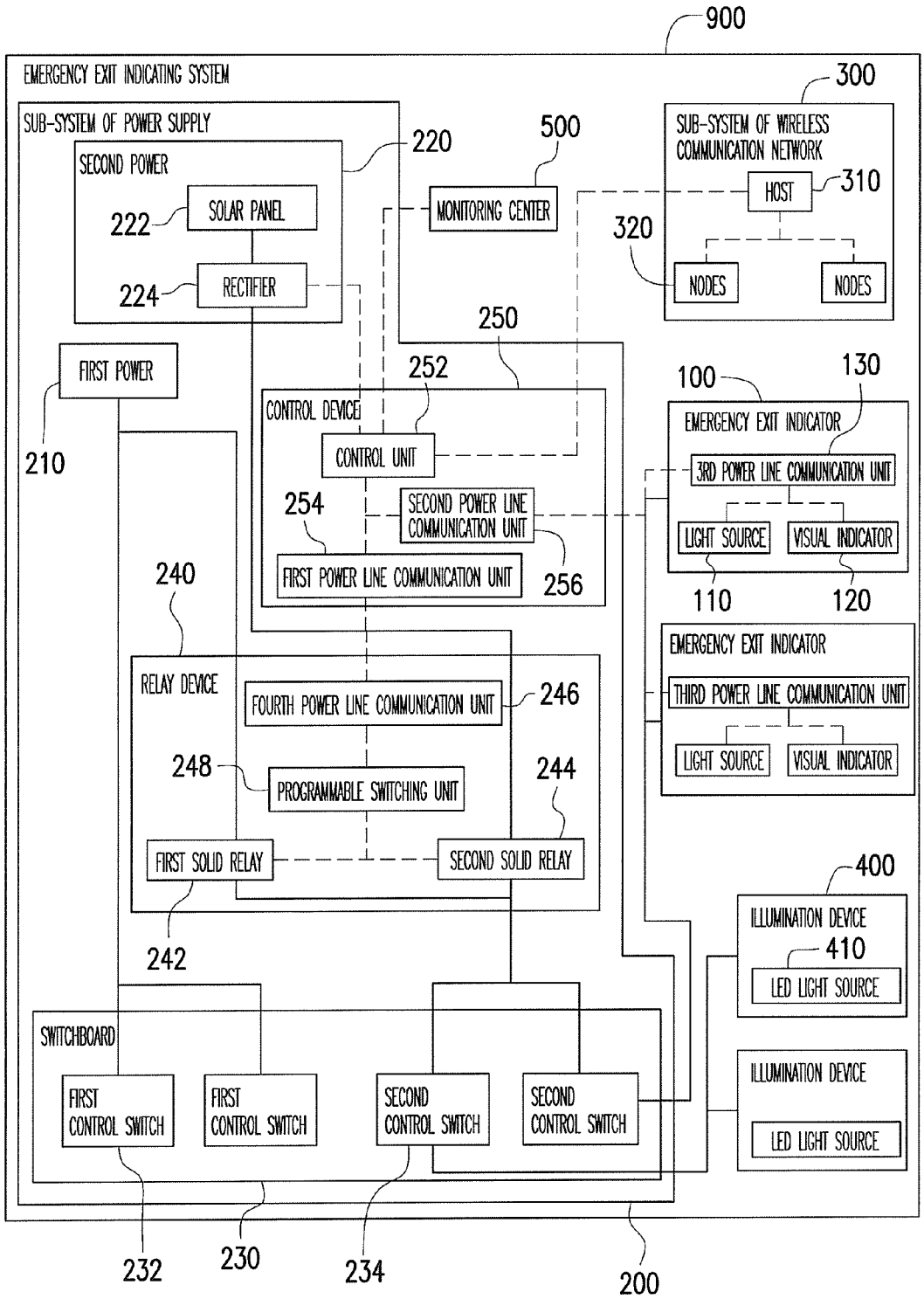
FIG. 11 is a block diagram of an emergency exit indicating system according to yet another embodiment of the present invention.

Besides, the emergency exit indicating system can make the above-mentioned sub-system of wireless communication network 300 and illumination devices 400 integrated therein. FIG. 11 is a block diagram of an emergency exit indicating system according to yet another embodiment of the present invention. Note that the present embodiment is partially similar to that of FIG. 10; therefore, the same parts or the similar parts as or to that of the embodiment of FIG. 10 are marked by the same or similar notations, and the same portions are omitted to describe for simplicity.

Referring to FIG. 11, in comparison with the emergency exit indicating system 800, the emergency exit indicating system 900 further includes a sub-system of wireless communication network 300. And the nodes 320 in FIG. 11 can be disposed within the emergency exit indicators 100 and in the illumination devices 400, and the illumination devices 400 provide the nodes 320 with required powers.

In summary, since the emergency exit indicator of the above-described embodiments has a power line communication unit (the third power line communication unit) and is able to alter the displayed information of the visual indicator, i.e. to dynamically alter the displayed information, therefore, the novel emergency exit indicator of the present invention can display the escape information more correct so as to reduce the casualty.

In addition, the control unit can obtain various information of the building from the monitoring center and accordingly plan a better escape path, which in association with controlling the emergency exit indicators through the second power line communication unit and the third power line communication unit makes the people at the site evacuated in safety.

When a disaster occurs in a building, the control unit controls the relay device to turn off the first power for safety; meanwhile, the control unit provides the emergency exit indicators with required electricity for assisting the site people escaped.

The emergency exit indicating system can be used together with a sub-system of wireless communication network, so that the control unit can obtain the information regarding the people distribution in the building from the host and further plan a better escape path.

The emergency exit indicating system can further together with an emergency illumination device to make the control device during the first power is shut off control the relay device. In this way, the second power is able to keep emergency power supply to the illumination devices, so that the site people have enough illumination to ensure a safety evacuation.

The emergency exit indicator can further include a sensor, a video camera or a WLAN node for further assisting the control unit planning an escape path.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like not necessarily limit the scope of the present invention to a specific embodiment, and the reference to particularly preferred exemplary embodiments of the invention does not imply a limitation on the present invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An emergency exit indicating system, comprising:
- a sub-system of power supply, comprising:
- a first power;
- a second power;
- a switch board, electrically connected to the first power;
- a relay device, electrically connected to the first power, the second power and the switch board; and
- a control device, comprising:
- a control unit, electrically connected to the second power;
- a first power line communication unit, electrically connected between the relay device and the second power line communication unit, and electrically connected to the control unit; and
- a second power line communication unit, electrically connected to the control unit;
- a monitoring center, electrically connected to the control unit; and
- a plurality of emergency exit indicators, electrically connected to the switch board, wherein each of the emergency exit indicators comprises:
- a light source;
- a visual indicator, disposed within an illumination scope of the light source; and
- a third power line communication unit, electrically connected to the light source, the visual indicator and the second power line communication unit.

2. The emergency exit indicating system according to claim 1, wherein the second power comprises:
- a solar panel; and
- a rectifier, electrically connected to the solar panel, the second solid relay and the first power line communication unit.

3. The emergency exit indicating system according to claim 2, wherein the second power further comprises:
- a storage battery, electrically connected to the solar panel and the rectifier.

4. The emergency exit indicating system according to claim 1, wherein the relay device comprises:
- a fourth power line communication unit, electrically connected to the first power line communication unit;
- a first solid relay, electrically connected to the first power and the switch board;
- a second solid relay, electrically connected to the second power and the switch board; and
- a switching unit, electrically connected to the fourth power line communication unit, the first solid relay and the second solid relay.

5. The emergency exit indicating system according to claim 1, wherein the relay device comprises:
- a fourth power line communication unit, electrically connected to the first power line communication unit; and
- a programmable logic controller unit (PLC unit), electrically connected to the fourth power line communication unit, the first power, the second power and the switch board.

6. The emergency exit indicating system according to claim 1, wherein the switch board comprises:
- a plurality of first control switches, electrically connected to the first power; and
- a plurality of second control switches, electrically connected to the relay device and the emergency exit indicators.

7. The emergency exit indicating system according to claim 1, further comprising:
- a sub-system of wireless communication network, comprising:
- a host electrically connected to the control unit; and
- a plurality of nodes connected to the host.

8. The emergency exit indicating system according to claim 7, wherein the sub-system of wireless communication network is a mesh network.

9. The emergency exit indicating system according to claim 8, wherein the sub-system of wireless communication network is an IEEE 802.15.4 ZigBee wireless communication system, a ZigBee-Pro wireless communication system or a Z-Wave wireless communication system.

10. The emergency exit indicating system according to claim 7, wherein the nodes are disposed within the emergency exit indicators.

11. The emergency exit indicating system according to claim 7, wherein the host has an independent power supply.

12. The emergency exit indicating system according to claim 7, wherein each of the nodes has an independent power supply.

13. The emergency exit indicating system according to claim 1, further comprising a plurality of illumination devices electrically connected to the switch board.

14. The emergency exit indicating system according to claim 13, wherein each of the illumination devices is an emergency illumination device.

15. The emergency exit indicating system according to claim 1, wherein the visual indicator comprises a direction-indicating sign.

16. The emergency exit indicating system according to claim 1, wherein the emergency exit indicator further comprises a speaker electrically connected to the power line communication unit.

17. The emergency exit indicating system according to claim 1, wherein the emergency exit indicator further comprises a sensor electrically connected to the power line communication unit.

18. The emergency exit indicating system according to claim 1, wherein the emergency exit indicator further comprises a video camera electrically connected to the power line communication unit.

19. The emergency exit indicating system according to claim 1, wherein the emergency exit indicator further comprises an independent power supply electrically connected to the light source, the power line communication unit and the visual indicator.

* * * * *